US006892889B2

(12) United States Patent
Hukki et al.

(10) Patent No.: US 6,892,889 B2
(45) Date of Patent: May 17, 2005

(54) SCREEN

(75) Inventors: Ari M. Hukki, Edgewood, KY (US); Keith J. King, Owenton, KY (US)

(73) Assignee: M-I, L.L.C., Houston, TX (US)

( * ) Notice: Subject to any disclaimer, the term of this patent is extended or adjusted under 35 U.S.C. 154(b) by 189 days.

(21) Appl. No.: 10/287,846

(22) Filed: Nov. 5, 2002

(65) Prior Publication Data

US 2003/0057140 A1 Mar. 27, 2003

Related U.S. Application Data

(62) Division of application No. 09/432,921, filed on Nov. 2, 1999, now Pat. No. 6,513,665.

(51) Int. Cl.[7] ..... B07B 1/49; B07B 1/36
(52) U.S. Cl. ..... 209/405; 209/309; 209/331
(58) Field of Search ..... 209/405

(56) References Cited

U.S. PATENT DOCUMENTS

| | | | | | |
|---|---|---|---|---|---|
| 231,382 | A | * | 8/1880 | Wells | 209/405 |
| 418,862 | A | * | 1/1890 | Bryan | 209/344 |
| 951,032 | A | | 3/1910 | Spring et al. | |
| 3,211,089 | A | * | 10/1965 | Messerschmidt | 101/127.1 |
| 4,082,657 | A | * | 4/1978 | Gage | 209/311 |
| 4,219,412 | A | * | 8/1980 | Hassall | 209/399 |
| 4,347,129 | A | * | 8/1982 | Rutherford | 209/399 |
| 4,582,597 | A | | 4/1986 | Huber | |
| 4,613,432 | A | | 9/1986 | Racine | |
| 4,810,372 | A | | 3/1989 | Jones | |
| 4,968,366 | A | | 11/1990 | Hukki et al. | |
| 5,221,008 | A | | 6/1993 | Derrick, Jr. et al. | |
| 5,226,546 | A | * | 7/1993 | Janssens et al. | 209/319 |
| 5,326,471 | A | * | 7/1994 | Pietzsch | 210/402 |
| 5,615,776 | A | | 4/1997 | Bjorklund et al. | |
| 5,785,461 | A | * | 7/1998 | Lambert | 403/167 |
| 6,253,926 | B1 | * | 7/2001 | Woodgate | 209/399 |
| 6,283,303 | B1 | * | 9/2001 | Lane et al. | 209/405 |
| 6,439,392 | B1 | * | 8/2002 | Baltzer | 209/405 |

OTHER PUBLICATIONS

U.S. Appl. No. 09/4432,921, filed Nov. 2, 1999, to Ari M. Hukki et al.

* cited by examiner

*Primary Examiner*—Donald P. Walsh
*Assistant Examiner*—Jonathan R Miller
(74) *Attorney, Agent, or Firm*—Fulbright & Jaworski L.L.P.

(57) ABSTRACT

A screen system employs a resiliently mounted housing, a vibration generator mounted to the housing, a mounting frame fixed to the resiliently mounted housing and a support surface. This system receives a screen including a screen frame and pre-tensioned screen cloth. The frame includes an inwardly extending mounting flange accessible from below the screen when placed in the housing. Clips pivotally mounted relative to the mounting frame include a first rounded lever extending upwardly to selectively engage the inwardly extending mounting flange. Second levers extend downwardly to cooperate with actuators. The actuators include inflatable bodies with contacts which, upon inflation, force the clips to engage the inwardly extending mounting flanges. This engagement retains the screen on a resiliently mounted housing and is able to further tension the screen in place.

7 Claims, 6 Drawing Sheets

38
24
56
22
26
52
40
36
50
64
46
48
34
54
60
66
68
62
14

38
24
48
56
22
52
26
40
36
50
46
55
74
34
66
59
70
54
55
64
68
44

SCREEN

This is a divisional of U.S. patent application Ser. No. 09/432,921, filed Nov. 2, 1999 now U.S. Pat. No. 6,513,665 allowed, the disclosure of which is incorporated herein by reference.

BACKGROUND OF THE INVENTION

The field of the present invention is tensioned screens having utility for vibratory separation.

Vibratory separators have long been used for separation of materials, both wet and dry. Such separators have been classically divided into rectangular screen separators and circular screen separators. An example of a rectangular screen separator is illustrated in U.S. Pat. No. 4,582,597, the disclosure of which is incorporated herein by reference. A circular separator is illustrated in U.S. Pat. No. 4,613,432, the disclosure of which is incorporated herein by reference. Each type of separator has its own advantages well known in the industry.

Vibratory separators may also be distinguished by the multiple ways that they provide tensioned screen cloth. One system is to employ untensioned screens using hook strips in association with tensioning mechanisms on the screening system. One such system is illustrated in U.S. Pat. No. 5,221,008. Alternatively, pretensioned screen panels including tensioned screen cloth affixed to rigid frames provide the tensioning mechanism. In such circumstances, tensioning mechanisms on the vibratory separators are avoided. The manufacture of such screens is disclosed in U.S. Pat. No. 4,968,366, the disclosure of which is incorporated herein by reference.

Hook strip screens which are tensioned on the screening device require a crown on the screen bed. Such a crown has proven to be disadvantageous with regard to the distribution of material on the screen. Such devices also require multiple fasteners along the sides of the screen deck which are time consuming to operate and are susceptible to errors in assembly.

Pretensioned screens have been incorporated into vibratory housings in circular screens by including screen frames with outwardly extending mounting flanges that are sandwiched between succeeding wall portions. Reference is made to U.S. Pat. No. 4,810,372, incorporated herein by reference, illustrating such flanges and their placement in the housing. Pretensioned screens which are rectangular have not employed outwardly extending mounting flanges. They have used clamps operating directly on the frame itself. One clamp system employs a pneumatic seal in association with channels to locate and retain such frames. Reference is made to U.S. Pat. Nos. 4,582,597 and 5,226,546, the disclosures of which are incorporated herein by reference.

SUMMARY OF THE INVENTION

The present invention is directed to screens capable of being mounted to vibratory screening equipment. The screens have a screen frame forming a rigid geometric shape with a screening element affixed thereto. The frame includes an inwardly extending mounting flange designed to allow retention of the screen from below. The flange is facing toward and at a distance from the screening element.

Accordingly, it is an object of the present invention to provide an improved screen for a screening system. Other and further objects and advantages will appear hereinafter.

DETAILED DESCRIPTION OF THE PREFERRED EMBODIMENTS

Figure 1:
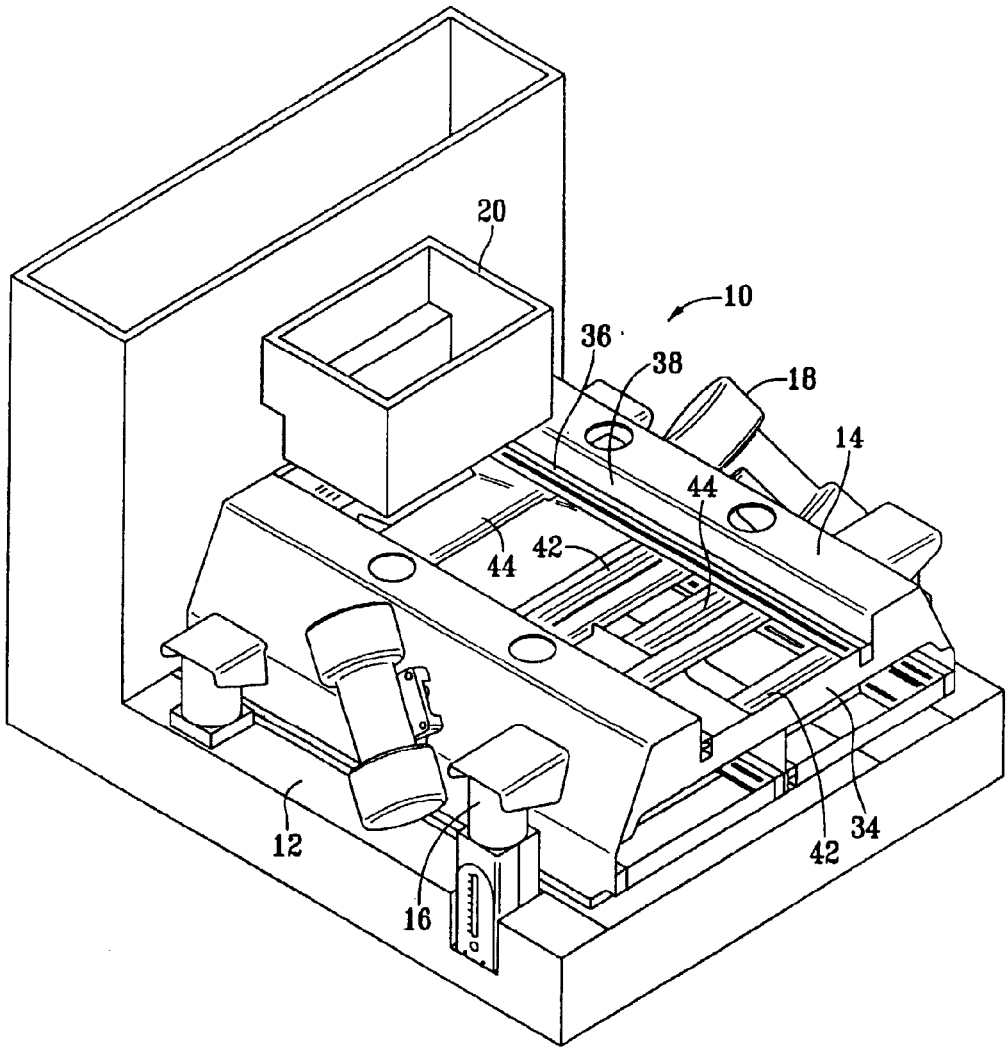
FIG. 1 is a perspective view of a vibratory screen separator.
Figure 2:
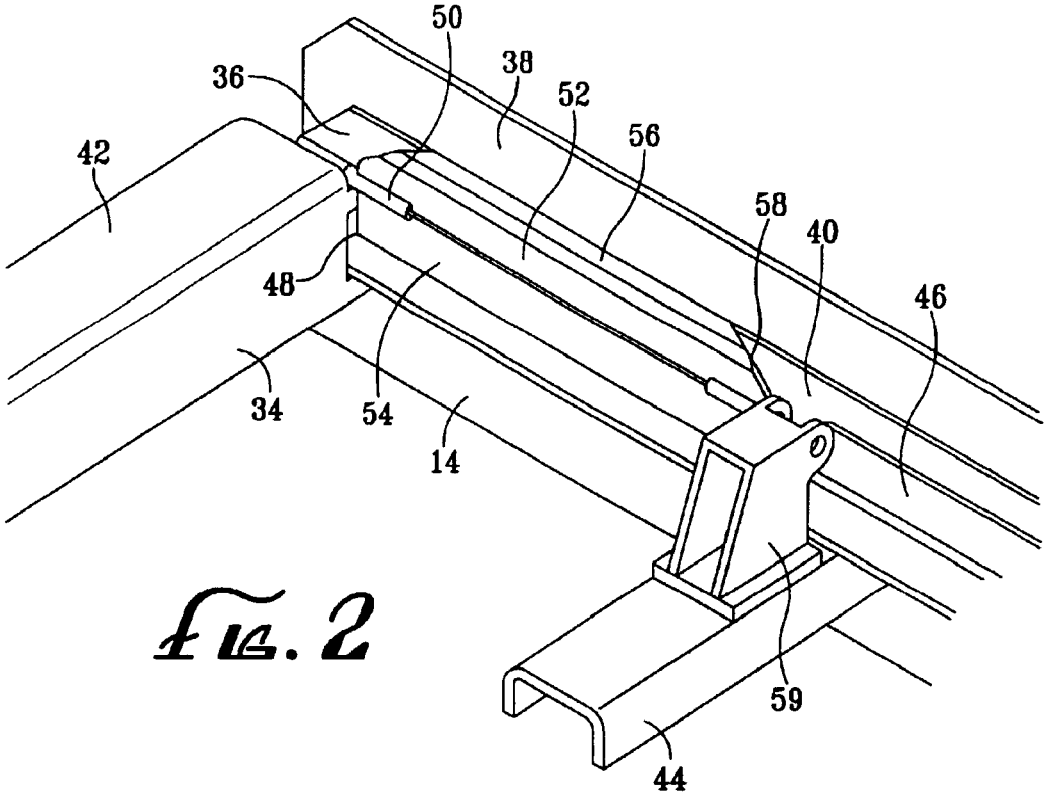
FIG. 2 is a perspective view of a detail of the vibratory screen separator.
Figure 4:
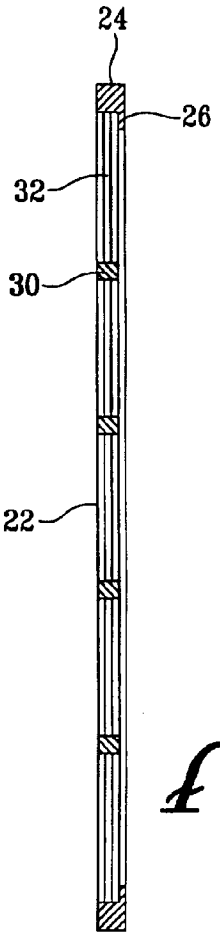
FIG. 4 is a cross-sectional edge view of the screen.

A vibratory screen system, generally designated 10, is illustrated in FIG. 1. The system includes a base 12, a resiliently mounted housing 14 mounted by spring elements 16 and vibration generators 18. The vibration generators 18 are rigidly fixed to the resiliently mounted housing 14. An inlet 20 is provided above the resiliently mounted housing 14 to distribute materials for screening.

The device illustrated as the vibratory screen system 10 is configured as a shaker, or shale shaker, used in the oil well drilling industry. Spent drilling mud returning from the hole is processed by such a shaker to separate sand and chips recovered from the well from the valuable drilling mud. The mud, once screened, is recycled to the hole.

Figure 3:
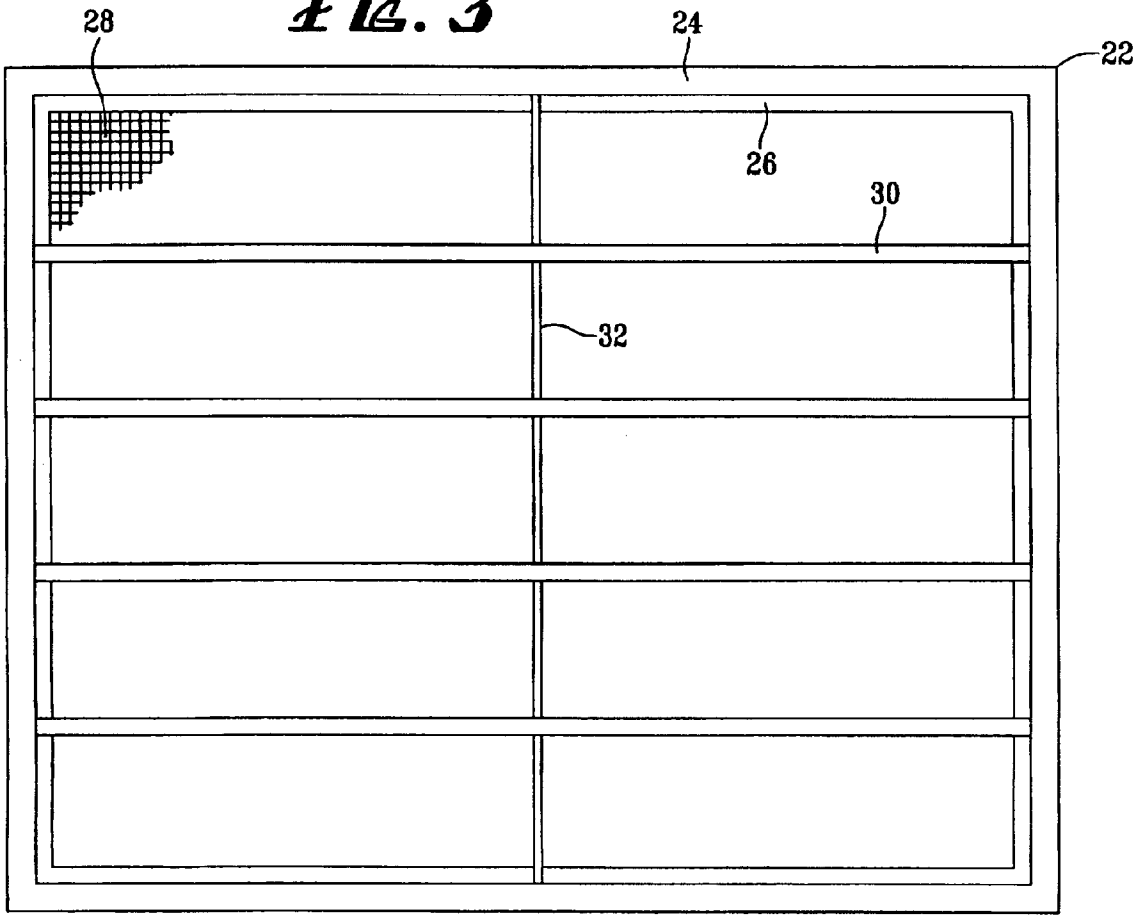
FIG. 3 is a plan view of a screen.
Figure 5:
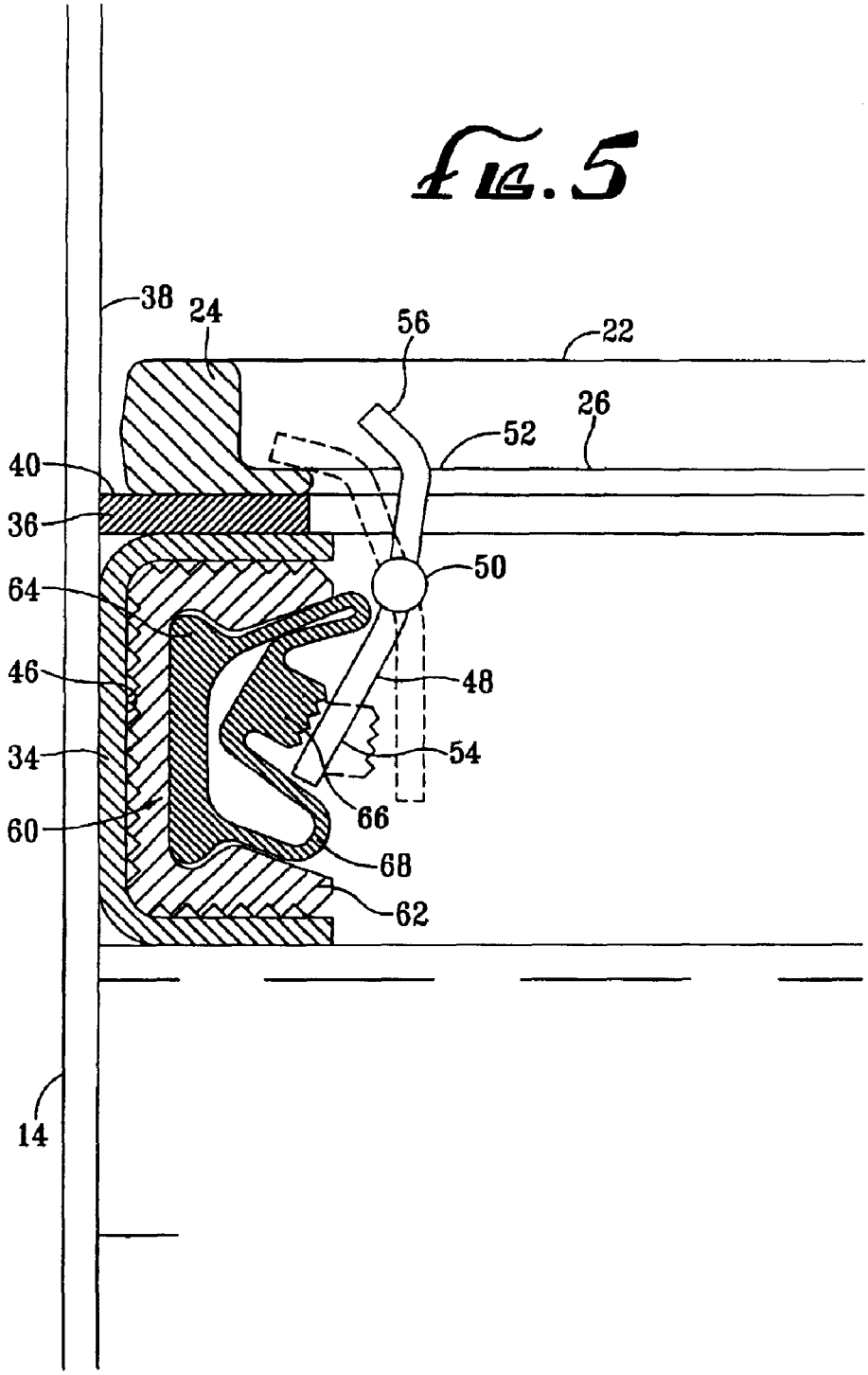
FIG. 5 is a cross-sectional side view of a screen frame and retaining system.

The screens 22 employed with this system are conventionally constructed rectangular pretensioned screens with the exception of the mounting flange extending inwardly, away from the periphery of the screen frame forming a mounting surface. The screen frame 24 is a right quadrilateral which could be square or rectangular as desired. The frame 24 includes a progressively formed hollow steel tube which is butt welded. The tube has a cross section which is roughly rectangular with the exception of a mounting flange 26 extending inwardly, away from the periphery. The portion of the sheet forming the frame 24 extends continuously across the bottom of the frame to form the lower surface of the mounting flange 26. The sheet is then bent back upon itself to form the upper surface of the mounting flange 26 and then is bent up and away from the bottom surface to further define the rectangular cross section of the frame. Alternatively, the frame 24 may be of solid, usually polymeric, material with internal reinforcing as needed. At least two, opposed sides of the screen frame 24 include the inwardly extending mounting flanges 26. All four sides of the frame 24 may include the flange 26 as seen in FIG. 3.

Screen cloth 28, forming a screening element, is tensioned across the upper side of the screen frame 24, bonded thereto and trimmed in a well known manner. The screens of the preferred embodiment are shown to include four support members 30 which are preferably aligned with the intended flow of material over the screen. These support members 30 extend to flush with the top surface of the screen frame 24 to support the screen cloth 28. The screen cloth 28 may be bonded to these support members 30. The support rod 32 extends from ones side of the frame 24 to the other in a perpendicular direction to the support members 30. The rod 32 contributes additional strength to the assembly.

Returning to the resiliently mounted housing 14, a mounting frame 34 includes side rails 36 bordered by upstanding walls 38. Two side rails 36 with adjacent upstanding walls 38 define a planar support surface 40 on the side rails 36 within a cavity defined by the upstanding walls 38. The walls 38 are spaced to closely accommodate the width of a screen frame 24. Frame cross members 42 extend between the side rails 36. These frame cross members 42 further define the support surface 40 by being spaced to also accommodate the screen frame 24 such that the support surface 40 will receive the underside of the screen frame in juxtaposition. Intermediate cross members 44 also extend between the side rails 36. The intermediate cross members 44 are positioned below the support surface. The mounting frame 34 further includes support cavities 46. The support cavities 46 face inwardly from the side rails 36 below the support surface 40.

A retaining system including clips controlled by actuators retains the screens on the resiliently mounted housing. Two clips 48 per side per screen are contemplated in the preferred embodiment. The clips 48 are positioned at least along the side rails 36 to engage with the mounting flanges 26 of the screens 22. The clips 48 are curved or bent metal plates with pins 50 welded thereto. The configuration may be considered as having an upper lever 52 and a lower lever 54. The upper lever 52 further includes a hook portion 56. The lower lever 54 includes a post 55 extending outwardly from the corner of the clip. Posts at either end may also be used where appropriate, such as to create a universal part. The pins 50 extend laterally from a position between the upper lever 52 and the lower lever 54.

The upper lever 52, lower lever 54 and hook portion 56 are roughly defined by bends in the metal plate of the clip 48. However, location of the various components can obviate the need for such bends and the device may take on other bends or constitute a simple flat plate. The exact lever configuration depends on the pivot location relative to the mounting flange 26 of an associated screen 22 and also depends on the location of the actuator discussed below. Generally, the upper lever 52 is considered above the pivot pins 50 while the lower lever 54 is below the pivot pins 50. The upper lever 52 at its distal end, the hook portion 56, includes round corners so that the screen frame 24 of a screen 22 slid along the side rails 36 will not hang up on one of the clips 48. The round corners 58 will act as a cam to move the clips 48 from interference with the ends of the frames 24.

The pins engage sockets provided for pivotal mounting. Sockets are defined within the frame cross members 42. The intermediate cross members 44 support brackets 59 which extend upwardly. These brackets also include sockets to either side to receive the pins of adjacent clips 48. The brackets 59 are preferably removable. Depending on the fit, the ability to remove the brackets 59 may be used to allow assembly with the pins 50 welded to the plates of the clips 48.

The clips 48 are aligned so that they are substantially parallel to the adjacent portions of the mounting frame 34 to capture a screen frame 24 between each clip 48 and the upstanding wall 38 while the screen is positioned on the side rails 36. The clips 48 engage the inwardly extending mounting flanges 26. This engagement may be forced such that the support frames are pushed outwardly to further tension the screen cloth 28 when the screen 22 is fully mounted to the resiliently mounted housing 14. Two clips 48 are associated with each side rail 36 of the mounting frame 34 to retain a given screen 22.

The actuators 60 are illustrated to be located within the support cavities 46. Elastomeric retainers 62 retain the actuators 60 in position. The actuators 60 are pneumatic and each includes a thick base 64 to interlock with an elastomeric retainer 62. An actuator contact 66 is connected to the base 64 by means of a flexible diaphragm 68. The diaphragm 68 cooperates with the base 64 to define an inflatable body. The diaphragm 68 is relaxed in a retracted position but can be inflated to an extended position with the actuator contact forced outwardly against the lower lever 54 of the clip 48. The actuators 60 may be a continuous tube or separately closed pneumatic devices associated with each clip 48.

Figure 6:
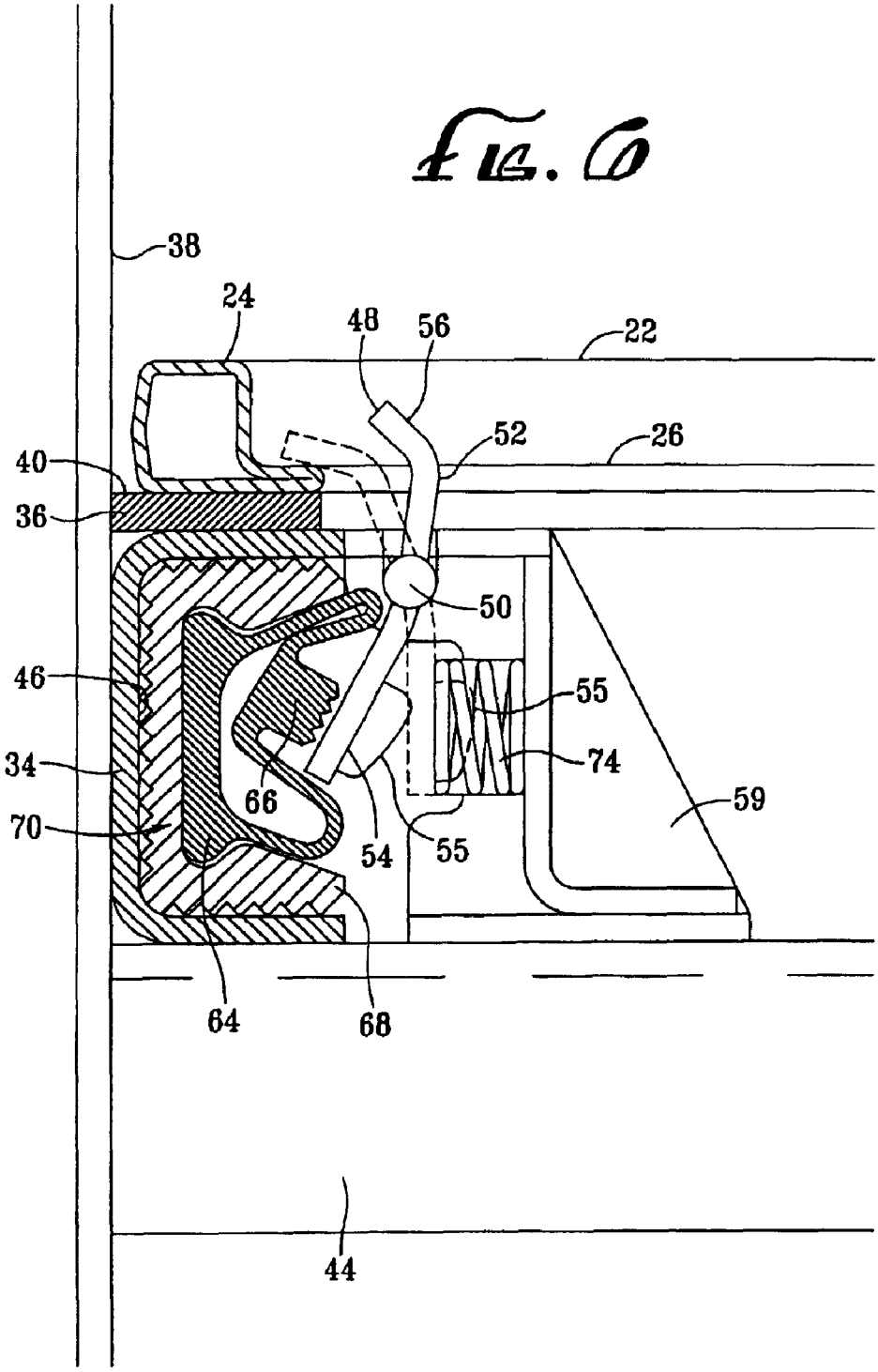
FIG. 6 is a cross-sectional side view of a screen frame and retaining system.
Figure 8:
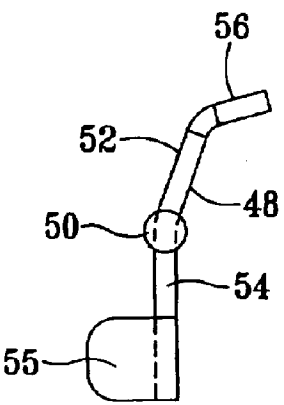
FIG. 8 is an end view of the retaining clip.
Figure 7:
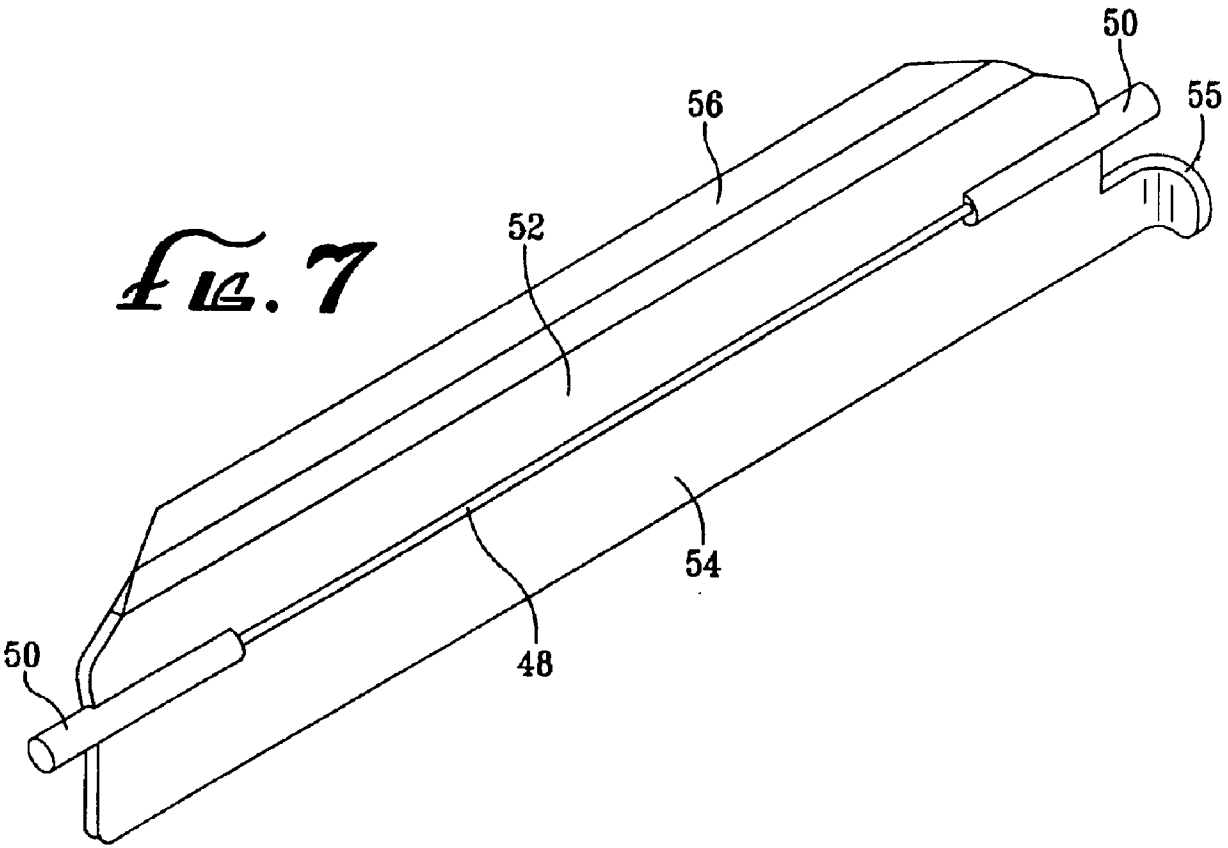
FIG. 7 is a perspective view of a retaining clip.

A return device 70 is illustrated in FIG. 6. The support brackets 59 on the mounting frames 34 each carry a resilient element in the form of a compression spring 74 which engages the lower lever 54 on each of the adjacent clips 48 to either side of each bracket 59 on the intermediate cross members 44. The spring 74 is in resilient deformation against the lower levers to insure that the clips 48 will take the retracted position when released for easy replacement and removal of the screens 22. The posts 55 located at least at one end of each of the lower levers 54 of the adjacent clips 48 extend to and fit within the spring 74. The adjacent clips 48 have the posts 55 at least at adjacent ends so that they will come together at the spring 74. Each spring 74 and the adjacent posts 55 interlock to retain the clips 48 from moving laterally. In doing so, the spring 74 may keep the clips 48 in position with the pivot pins 50 retained in the sockets in the frame cross member 42 and the support bracket 59.

Accordingly, an improved screen mounting system in a vibratory screen separator is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A method of securing a screen to a vibratory mounting frame comprising:

pre-tensioning a screening element across a screen frame, the screen frame forming a rigid geometric shape and including a mounting flange, wherein the mounting flange extends from the screen frame inwardly into the rigid geometric shape and includes a mounting surface facing toward and at a distance from the screening element;

juxtaposing the screen frame with a support surface of the mounting frame; and securing the mounting flange between the support surface and clips movably mounted relative to the mounting frame to engage the mounting surface.

2. The method of claim 1, the clips being pivotally mounted relative to the mounting frame, wherein securing the mounting flange between the support surface and the clips includes pivoting the clips to engage the mounting surface.

3. The method of claim 2, each clip having a first lever extending from the pivot mounting to above the support surface and a second lever extending from the pivot mounting to below the support surface, wherein pivoting the clips to engage the mounting surface includes operatively engaging the second levers with actuators fixed relative to the mounting frame, respectively.

4. The method of claim 2, each clip having a first lever extending from the pivot mounting to above the support surface and a second lever extending from the pivot mounting to below the support surface, wherein pivoting the clips to engage the mounting surface includes inflating inflatable bodies and engaging the second levers with the inflatable bodies, respectively.

5. A method of securing a screen to a vibratory mounting frame comprising pre-tensioning a screening element across an upper side of a screen frame, the screen frame forming a rigid geometric shape and including a mounting flange, wherein the mounting flange extends from a loser side of the screen frame inwardly into the rigid geometric shape and includes a mounting surface between the upper and lower sides of the screen frame and facing toward and at a distance from the screening element;

juxtaposing the screen frame with a support surface of the mounting frame; and securing the mounting flange between the support surface and clips pivotally mounted relative to the mounting frame, each clip having a first lever extending from the pivot mounting to above the support surface for engaging the mounting surface.

6. The method of claim 5, each clip having a second lever extending from the pivot mounting to below the support surface, wherein securing the mounting flange includes operatively engaging the second levers with actuators fixed relative to the mounting frame, respectively.

7. The method of claim 5, each clip having a second lever extending from the pivot mounting to below the support surface, wherein securing the mounting flange includes inflating inflatable bodies and engaging the second levers with the inflatable bodies, respectively.

* * * * *